US005975979A

United States Patent [19]

Ferri Llorens

[11] Patent Number: 5,975,979

[45] Date of Patent: Nov. 2, 1999

[54] SOUND-EMITTING DOLL WITH MOUTH AND ARM MOVEMENT AND CAPABLE OF REMOVING ITS PACIFIER BY ITSELF

[75] Inventor: Jaime Ferri Llorens, Onil, Spain

[73] Assignee: Onilco Innovacion S.A., Onil, Spain

[21] Appl. No.: 08/692,037

[22] Filed: Aug. 2, 1996

[30] Foreign Application Priority Data

Aug. 2, 1995 [ES] Spain ..... 9501576

[51] Int. Cl.[6] ..... A63H 3/28

[52] U.S. Cl. ..... 446/301; 446/130; 446/304

[58] Field of Search ..... 446/130, 301, 446/304, 305

[56] References Cited

U.S. PATENT DOCUMENTS 3,571,967 3/1971 Glass et al. ..... 446/304

5,190,492 3/1993 Berenguer ..... 446/304 X

FOREIGN PATENT DOCUMENTS 2077117 12/1981 United Kingdom ..... 446/130

*Primary Examiner*—Robert A. Hafer

*Assistant Examiner*—Jeffrey D. Carlson

*Attorney, Agent, or Firm*—Howell & Haferkamp, L.C.

[57] ABSTRACT

The doll of the invention includes an internal mechanism based on gears, cams and terminations by virtue of which a series of movements are performed to provide a) swinging of the left arm, causing a rattler attached to said arm's hand to sound; b) stopping these movements and initiating movement of the second arm, bending the arm at the elbow and closing the hand in an approaching and grabbing motion on the pacifier previously inserted in the doll's mouth, opposite movements of said second arm being performed thereafter to pull out the pacifier, it being released from the hand holding it as a result of the pacifier being attached to a tether placed around the doll's neck. This cycle is repeated every time the pacifier is placed in the doll's mouth, thus simulating real-life movements for sounding the rattler and then removing the pacifier by itself.

7 Claims, 4 Drawing Sheets

SOUND-EMITTING DOLL WITH MOUTH AND ARM MOVEMENT AND CAPABLE OF REMOVING ITS PACIFIER BY ITSELF

BACKGROUND

1. Field of the Invention

The invention is related to a sound-emitting doll provided with mouth and arm movement and capable of removing its pacifier by itself; characterized in that, when the doll is activated by a switch, it emits a sound, in some cases a laughing and in others a crying sound, which ceases once the pacifier is placed in the mouth, at which time a mechanism is activated to generate movement of mouth and arms.

2. Description of the Prior Art

Dolls are known to perform numerous and varied movements such as walking, moving the arms to simulate eating, and opening and closing the eyes, although no doll is known to perform the function of removing its pacifier by itself in an attitude simulating anger, in addition to moving one of its arms in an attitude of handling a rattler, all of which is combined with partial opening and closing of the mouth when the pacifier is inside the mouth, in an attitude of tasting and moving the pacifier, according to motions which in every case appear to be real.

SUMMARY OF THE INVENTION

More specifically, the inventive doll, further to being provided with an internal conventional sound device which is turned on each time a switch is activated when the pacifier is out of the mouth, comprises a gear, lever and eccentric wheel mechanism in addition to parts which act in synchronized fashion, whereby the moment the pacifier is placed in the doll's mouth, the mechanism is activated to provide initial movement to the first arm, with an up- and-down swinging motion which ends abruptly to provide a corresponding movement and impulse to a rattler attached to said arm which is made to sound realistically, this being repeated several times until the mechanism, based on the movement of the gears, acts on the first arm to make it bend around the elbow, approach the mouth, partially close the hand, grab the pacifier and pull to remove it from the doll's mouth, thereafter releasing it abruptly due to the fact that the pacifier is associated to a tether attached to the doll's neck, the length between the end of the arm (hand) and the neck being greater than that of the tether supporting the pacifier; thus, as the arm moves outward upon removal of the pacifier from the mouth, a moment comes when it cannot be withdrawn further, this being prevented by the tether, and a sudden release of the pacifier is simulated as a result of the doll's hand performing an outward movement longer than that allowed by the tether.

All these movements are accompanied by others which simulate real life movements, in view that when the arm supporting the rattler moves, the mouth is partially opening and closing in an attitude which simulates sucking the pacifier; whilst when the second arm bends to grab the pacifier, the mouth opens wider to enable easy extraction of the pacifier by a pulling action, this being conducted by means of magnetized parts fitted in the hand and in the pacifier.

While one arm is moving, the other arm is still, this cycle being repeated indefinitely each time the pacifier is inserted in the doll's mouth; if the pacifier is loose, sound is emitted (laughter when the doll is sitting up and crying when lying down).

The mechanism is formed around a pair of main sprockets installed free on the same shaft, one of them being axially movable, said sprockets being driven by a motor-driven gear. The sprockets are each fitted with a different number of teeth, namely one of the sprockets has one additional tooth in order to cause a phase difference in the angular position, thereby causing one of the sprockets to be axially offset in regard to the other sprocket through ramps provided on the sides facing each other. When both main sprockets are in the closest position, the first arm holding the rattler is moved by an eccentric wheel and the mouth is moved by levers; however, when one of said main sprockets is axially offset in respect to the other, the second arm is moved by cams and eccentric wheels which, combined with a pinion, rods, and levers, cause the bending of the arm, the closing of the hand and the pulling out of the pacifier. The mechanism is complemented by a cam mounted in correspondence with the opposite part—i.e. in correspondence with a lever which causes opening and closing of the mouth—designed to cause a more extensive movement of the lever, thereby making the mouth to open wider and thus allowing removal of the pacifier.

The doll is fitted with terminations, switches and other elements allowing for synchronized and continuous movements and the switching-on of the sound-emitting device to emit either laughter or crying.

BRIEF DESCRIPTION OF THE DRAWINGS

In order to complement the subsequent description and help to better understand the characteristics of the invention, a detailed description is provided based on a set of drawings attached to this specification and forming a part thereof, in which the following is represented to have a merely orienting, non-limiting character.

DESCRIPTION OF THE PREFERRED EMBODIMENTS

Figure 1:
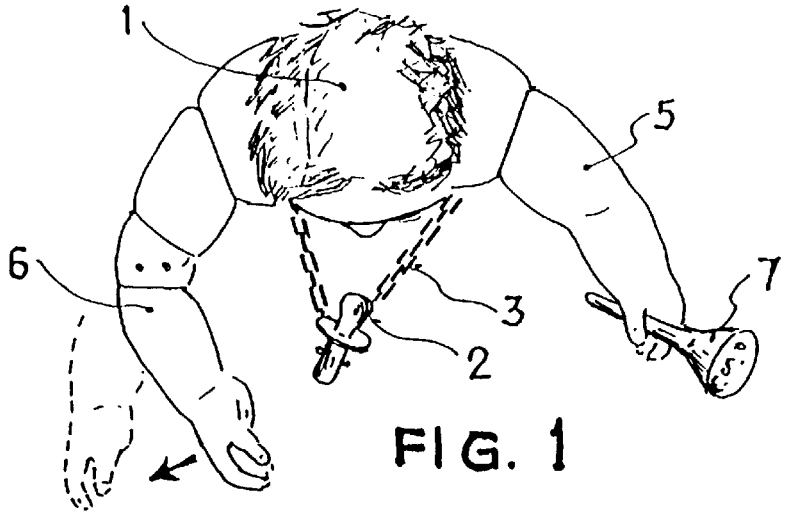
FIG. 1 shows an upper view of the doll as it releases the pacifier after removing it from its mouth.
Figure 2:
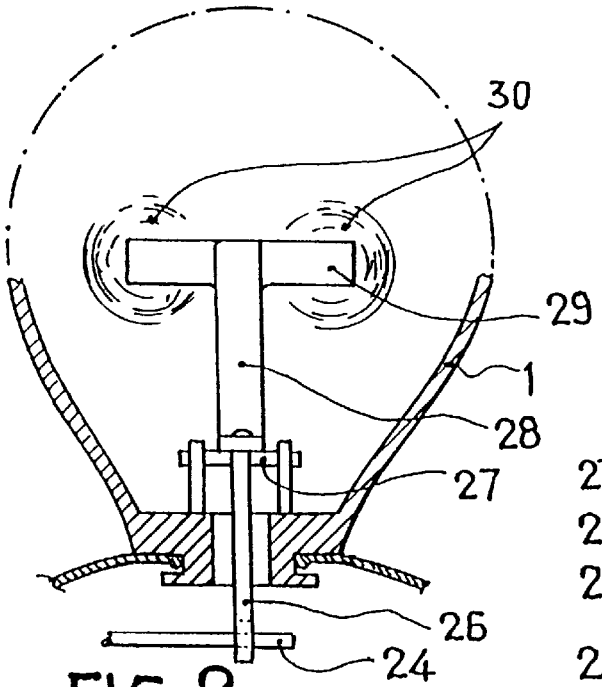
FIG. 2 shows a cross-sectional view of the head, revealing the levers that move the mouth
Figure 3:
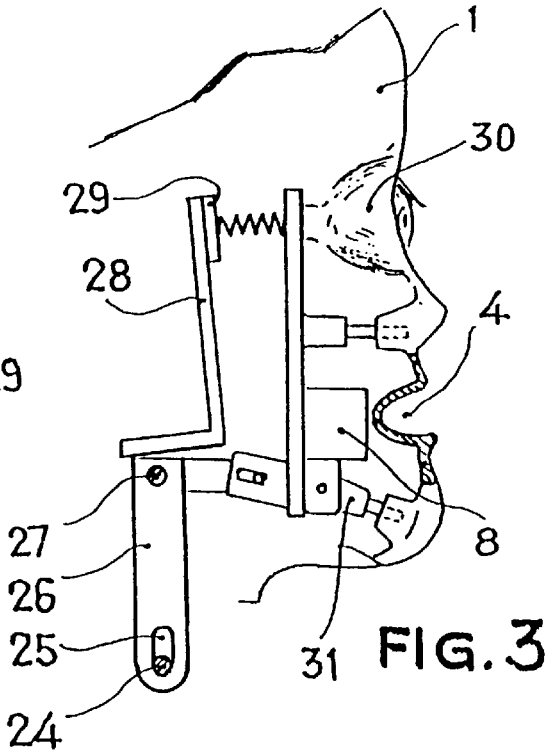
FIG. 3 shows a side view of part of the lever mechanism shown in the previous figure.

As shown in the figures under reference, the doll (1) of the invention includes a pacifier (2) attached to a pacifier holding tether (3), said pacifier (2) being liable of being inserted in the doll's mouth (4) in order to perform the functions described hereunder.

Said doll (1) is provided with a first arm (5) and a second arm (6) which move independently to implement different functions, movement of the first arm being required to sound the rattler (7) attached to the hand of said first arm (5), while the second arm (6) is required to pull out and remove the pacifier (2) when it is inserted in the mouth (4).

Behind the mouth (4), i.e. inside the doll's (1) head, at the height of the mouth (4), a switch (8) is installed whose function is described further on.

Inside the body of the doll (1), a motor (9) is installed which, through adequate drive means (10), causes a long pinion (11) to rotate, onto which two main sprockets (12) and (13) engage in a simultaneous and permanent manner, mounted free on a sprocket shaft (14) in such a way that the first sprocket (12) is capable of moving axially along said sprocket shaft (14) in order to approach and/or move away from second sprocket (13), which remains fixed in the axial direction.

Second sprocket (13) rotates free over a concentric housing (15) integral to sprocket shaft (14) and fitted with internal grooves which mesh with third pinion (16) integral to the inner side of first sprocket (12), said third pinion being fitted, on the other side of first sprocket (12), with an opposing portion (16').

Furthermore, first and second sprockets (12) and (13) are fitted on their inner or facing sides with projections (17) which constitute ramps (18) liable of sliding over one another, thus causing first sprocket (12) to move away from second sprocket (13) as a result of first and second sprockets (12) and (13) having a different number of teeth, one of the sprockets being provided with one extra tooth in respect to the other, thereby causing a phase difference in the angular position in order to make the ramps (18) forming the projections (17) to face each other and slidingly make first sprocket (12) to move away from second sprocket (13).

At the end of sprocket shaft (14), facing the first arm (5), a first pinion (19) is attached which remains engaged to third sprocket (20) onto whose external side is attached a first eccentric wheel (21) capable of acting on a first lever (22) biased by a spring (23), said first lever (22) projecting upwards, being fitted with an elbow and finishing in a crosswise rod (24) which acts on an elongated hole (25) in a head lever (26) hinged to a head shaft (27) related to a first branch (28) integral to a support (29) related to the eyes (30) of the doll (1).

Likewise, the second branch of head lever (26) is related throug chin lever (31) to the chin or lower internal part of the mouth (4) to cause partial opening and closing of the mouth (4) and also leading to wider opening at a given stage, as will be explained further on.

At the end of second shaft (32), onto which third sprocket (20) is freely fitted, third cam (33) is in turn integrally mounted, while on sprocket shaft (14) of first pinion (19) a third eccentric wheel (35) is fitted from which emerges an appendix (34),said appendix (34) of third eccentric wheel (35) impacting on first lever (22), the first arm (5) being fitted with a pivot located in depression (37) of first lever (22) to produce a sudden impact on the swinging arm (5) which provides movement to the rattler (7), which is thus made to sound.

Furthermore, onto second shaft (32) is integrally mounted a fith sprocket (38) into which the opposing portion (16') of third pinion (16) meshes when first sprocket (12) is axially offset in respect to second sprocket (13). Also, onto said second shaft (32) is integrally mounted a second eccentric wheel (39) on whose external side is attached a second pinion (40) which meshes with a fourth sprocket (41) associated to the second arm (6) through the arm's assembly means.

The second eccentric wheel (39) is provided with a flat area (42). This second eccentric wheel (39) acts on a second lever (43) biased by a spring (44) and fitted with an opening (45) acted on by pivot (46) pertaining to second arm (6).

Over the same second shaft (32), a first cam (47) is mounted to act as a disconnecting means at a specific moment, as explained hereunder.

In inner side of third sprocket (20), a circular projection (20') is provided that is fitted with a lateral butt end or second cam (48) for switching off a contact (49), said position coinciding with the highest point of the first eccentric wheel (21) so that each time the device stops after acting on the switch or as a result of the pacifier being removed from the mouth (4), which remain open and the pacifier (2) can thus be inserted in the mouth. This termination also puts an end to the movement cycle.

Figure 12:
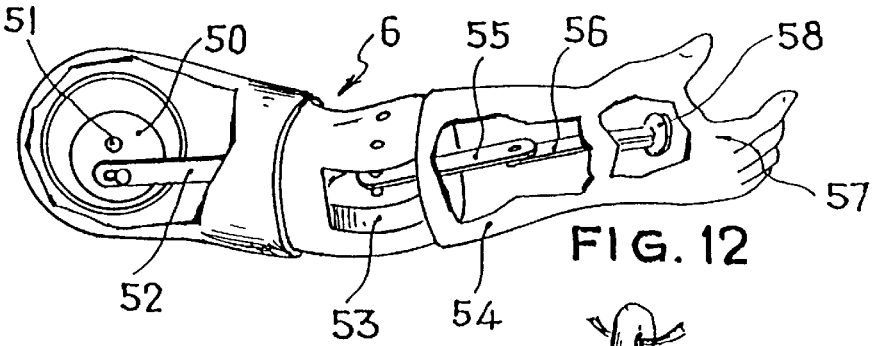
FIG. 12 shows a lengthwise sectional view of the second arm, revealing the various parts and components which cause the bending of the arm and the closing of the hand.

Concerning second arm (6), shown independently in FIG. 12, it comprises an internal or fourth eccentric wheel (50) mounted on fourth sprocket (41) associated to arm (6), said fourth eccentric wheel (50) acting on an upper arm rod (52) extending up to the area of the elbow, where a kind of hinge joint (53) acts upon the movements provided by said upper arm rod (52) to bend the elbow (54).

From hinge joint (53) emerges a forearm rod (55) hinged to a hand rod (56) adhered by its free end to the palm of the hand (57) in order to provide a closing of the hand, a magnet (58) being provided inside the hand.

Figure 4:
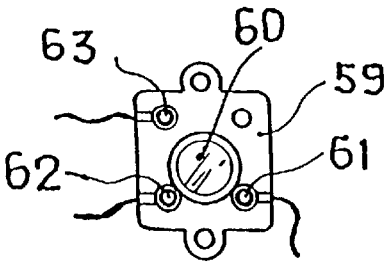
FIG. 4 shows the switch in the position whereby the laughter sound-emitting device is activated, corresponding to the sitting-up position of the doll.
Figure 5:
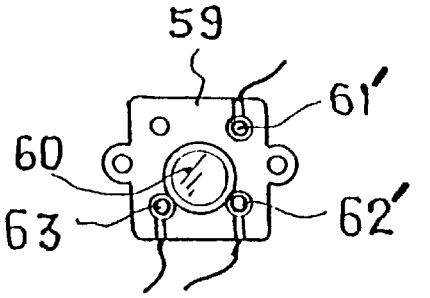
FIG. 5 shows the switch shown in the previous figure, in the position whereby the crying sound-emitting device is activated, corresponding to the lying-down position of the doll.

Regarding the sound-emitting device switch shown in FIGS. 4 and 5, it includes a housing (59) inside of which a roller (60) is fitted which, depending on the position of the switch (corresponding to the sitting-up position shown in FIG. 4 or the lying-down position in FIG. 5) rests on contacts 61'–62' or 62'–63 and closes the circuit activating the sound-emitting device to emit laughter (sitting-up position in FIG. 4) or crying (lying-down position in FIG. 5).

Based on the above description, operation is as follows:

As already pointed out, when the doll (1) is sitting up, the sound-emitting device selecting switch is in the position shown in FIG. 4, in which case, if the switch is activated and the mechanism is put in operation, the doll (1) emits a laughing sound. If the doll (1) is laid down, the switch is positioned as shown in FIG. 5 and the doll emits a crying sound.

Thus, in said circumstance and both in the sitting-up and lying-down position, the movements of the various components and parts in the doll are the same. Therefore, when the general switch is activated and the pacifier (2) is outside the mouth (4), an uninterrupted laughing or crying sound will be emitted, depending on the doll's position.

Figure 6:
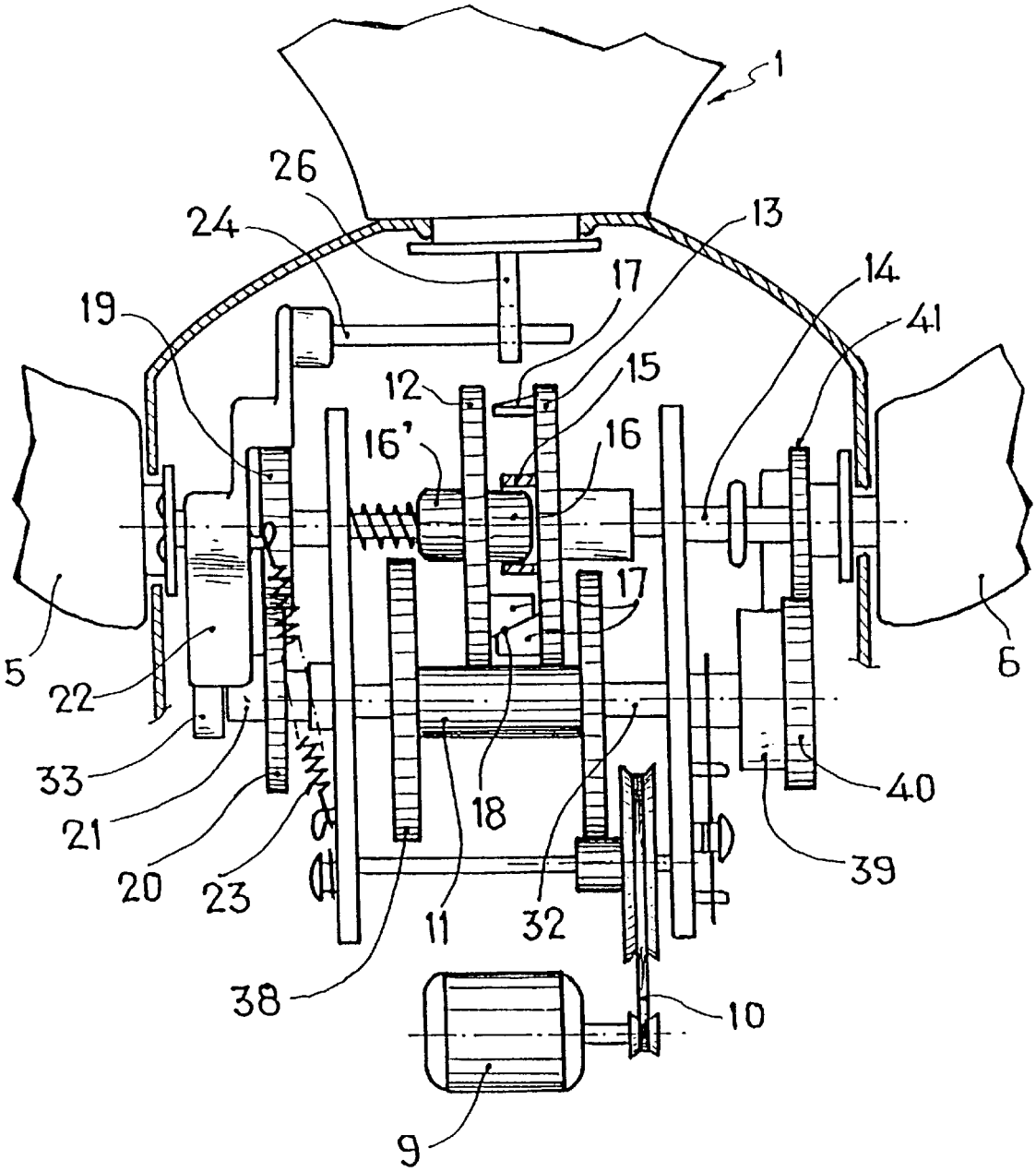
FIG. 6 shows a rear view of the gearing mechanism in the first arm drive position for moving the rattler and the mouth.

Then, when the pacifier (2) is inserted in the mouth (4)—an act performed by the child or the user of the doll—the magnet inside the pacifier (2) attracts the metal body (61) provided in the switch (8) located inside the mouth, the sound-emitting device is switched off and the motor (9) is switched on, causing rotation of first and second sprockets (12) and (13) which are now located in their closest mutual position, as shown in FIG. 6, therefore causing the rotation of sprocket shaft (14) via internally grooved housing (15) and, as a result, the rotation of first pinion (19) which, being engaged to third sprocket (20), makes the latter rotate also. Under these conditions, the first eccentric wheel (21) rotates integrally with said third sprocket (20), acting on first lever (22) which, through rod (24), moves the parts associated to the chin or lower internal part of the mouth, causing a partially sequential opening/closing of the mouth this in order to simulate sucking on the pacifier (2), although it prevents it from leaving the mouth (4). Simultaneously first lever (22) biased by a spring provide the first arm (5) with an up-and-down swinging motion through a pivot of said first arm (5) logged in depression (37) of first lever (22); an appendix (34) of third eccentric wheel (35) impacting on first lever (22) at the end of said swinging motion making the rattler (7) in the hand of said first arm (5) to sound.

Figure 7:
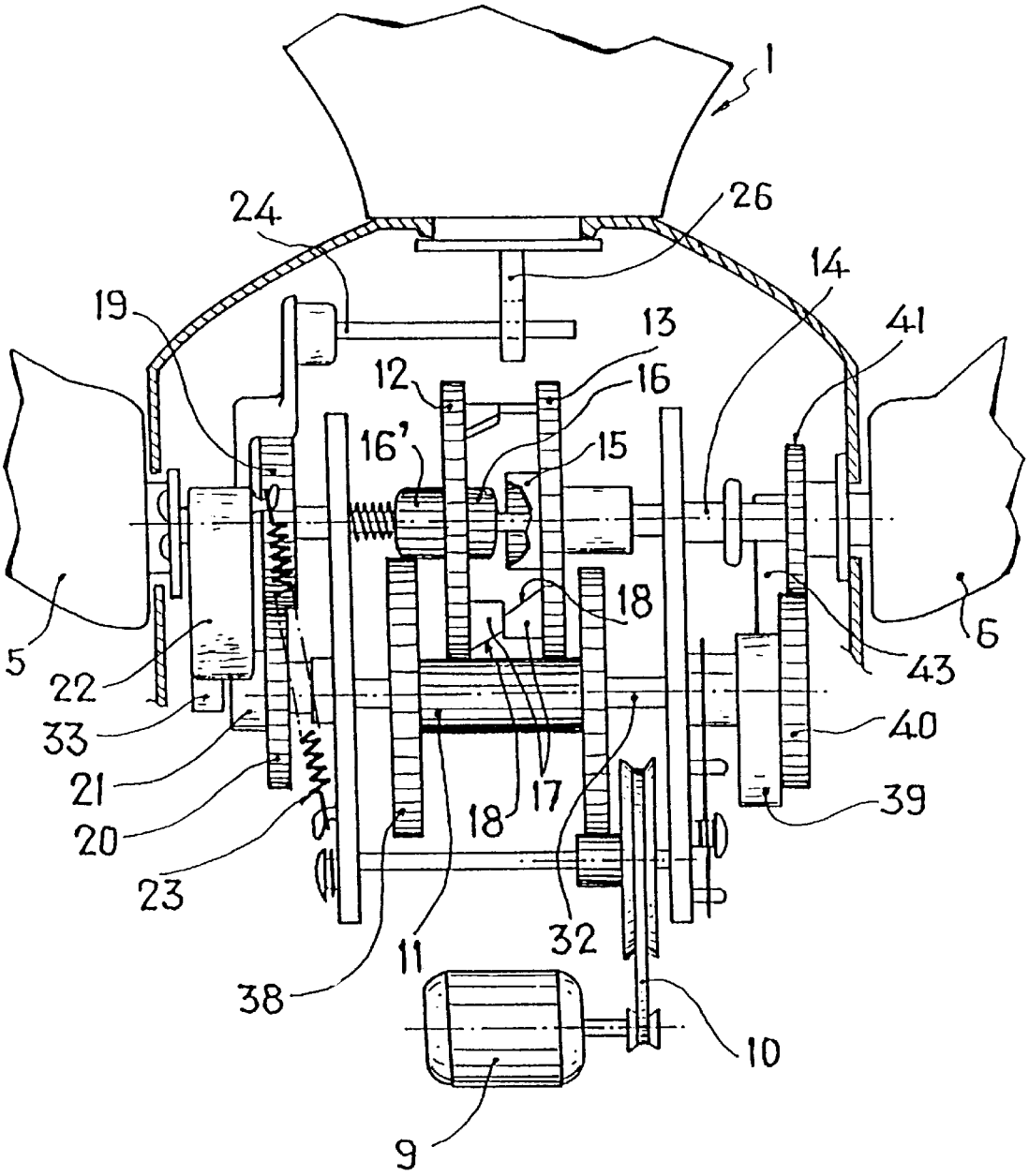
FIG. 7 shows the previous view, although in this case the gearing mechanism is in the second arm drive position for removing the pacifier.
Figure 8:
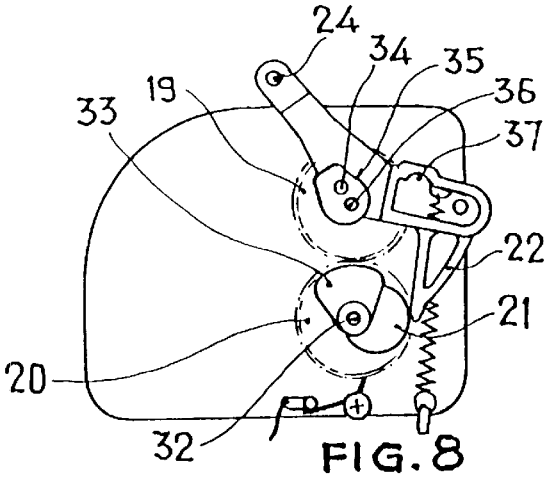
FIG. 8 shows a side detail of part of the first arm driving mechanism, in addition to the mechanism acting on the lever for transmitting movement to the mouth.
Figure 9:
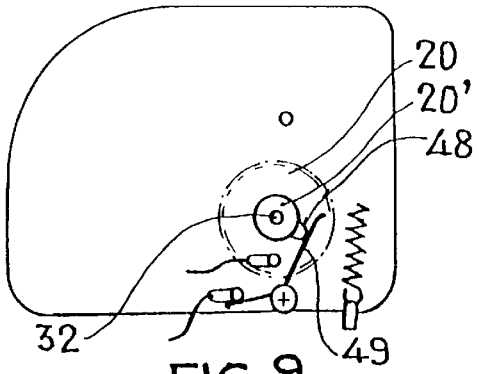
FIG. 9 shows a side detail of the manner in which disconnection is performed on completion of a movement cycle or when the doll is switched off.

Throughout these movements, i.e. during rotation of sprocket shaft (14), withdrawal of first sprocket (12) in respect to second sprocket (13) is taking place by virtue of the different number of teeth in said sprockets and the mutual sliding of the ramps (18) in both sprockets. This separation of the first and second sprockets continues until third pinion (16) disengages from internally grooved housing (15), at which time sprocket shaft (14) stops and all movement ceases in the first arm (5), the mouth (4). However, this offsetting of first sprocket (12) causes opposing portion (16') of third pinion (16) to mesh with fith sprocket (38), as shown in FIG. 7. At this point, second shaft (32), and consequently second pinion (40), second eccentric wheel (39) and fourth sprocket (41), begin to rotate, the second eccentric wheel (39) acting on second lever (43) carrying pivot (46) of the second arm (6), resulting in movement of said arm that initially produces the simultaneous raising of the second arm (6) and an approach—by bending the arm and closing its hand— toward the pacifier (2) and subsequently conducting opposite movements which cause the doll itself to remove the pacifier by pulling from it as a result of the magnet (58) incorporated inside the hand (57) of said second arm (6) acting on the magnet inside the pacifier (2).

The movements of said second arm (6) are performed as a result of its assembly area internal face being provided with a fourth eccentric wheel (50) integral to fourth sprocket (41) and designed to transmit movement to upper arm rod (52) and act on hinge joint (53) installed in elbow (54), causing elbow (54) of second arm (6) to bend and thus to pull forearm rod (55), which in turn pulls on hand rod (56), integral to the palm of hand (57), making the hand to close and so to simulate the grabbing of the pacifier (2) (FIG. 11), so that in the opposite movement a pulling is exerted to remove the pacifier (2) from the mouth (4). The pacifier (2) is adhered to hand (57) until the second arm (6) withdraws to a distance greater than the distance allowed by the tether (3) attaching the pacifier (2), thus making the latter to drop freely and abruptly to imply that the doll (1) is rejecting the pacifier (2).

Figure 11:
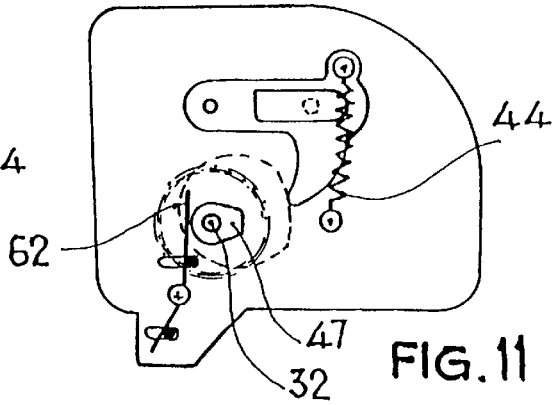
FIG. 11 shows the detail of the previous figure although in a different operational phase, with the arm in lifted position and the hand holding on to the pacifier.
Figure 13:
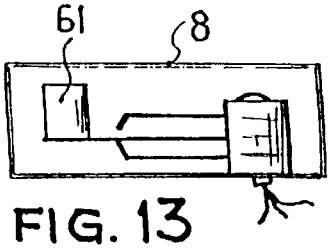
FIG. 13 shows the connector in sound-emitting position.
Figure 14:
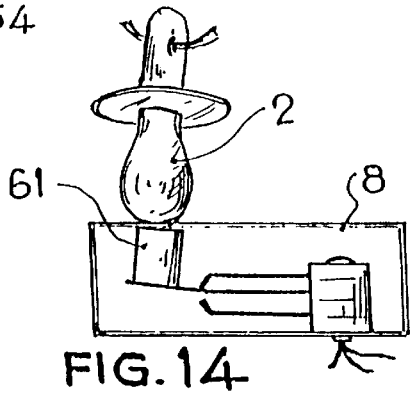
FIG. 14 shows the connector in operating mechanism position.

While these movements are in progress, a first cam (47) acts on a termination or contact (62) to connect the circuit corresponding to the mechanism in FIG. 11 (in view that, when the pacifier leaves the mouth, the mouth switch (8) would switch off the mechanism without completing the cycle in FIG. 13).

Figure 10:
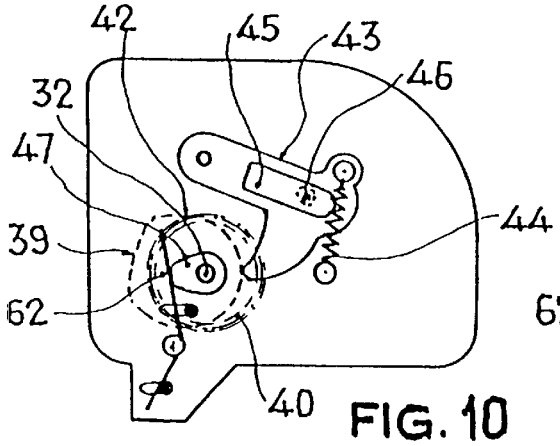
FIG. 10 shows a side detail of part of the second arm driving mechanism.

When first cam (47) disconnects the termination or contact (62) (FIG. 10), first sprocket (12) passes from the position in FIG. 7 to the position in FIG. 6, making the sprocket shaft (14) and internally grooved housing (15) to rotate together with circular projection (20') and second cam (48) so as to disconnect the corresponding contact (49), thus completing the movement cycle causing crying or laughter until the pacifier is reinserted in the mouth.

The second eccentric wheel (39) is provided with a flat area (42), enabling the second lever (43) which makes the second arm (6) move, to maintain the arm motionless for a short period of time as it reaches the pacifier with the hand.

As previously stated, at the time that said movements are taking place in the second arm (6), the third cam (33) mounted on second shaft (32) acts on first lever (22) to produce maximum tilting of the lever and therefore a maximum opening of the mouth (4), this condition taking place when the hand (57) reaches for the pacifier (2), thereby allowing the pacifier (2) to be removed.

I claim:

1. A sound-emitting doll provided with movement of its mouth and first and second arms with hands and capable of removing a pacifier by itself, comprising a pacifier held by a tether placed around the doll's neck, which pacifier can be placed on the doll's mouth by a child or other user, further comprising a sound-emitting device capable of emitting a laughter or crying sound, depending on whether the doll is sitting up or lying down, the corresponding sound being emitted until the moment the pacifier is inserted in the mouth, wherein the doll includes a magnetic switch (8) inside the mouth (4) which is activated by the pacifier (2) to start-up a mechanism that produces movement and halts the sound-emitting device incorporated in the doll; said mechanism being powered by a motor (9) which causes the rotation of a first and second sprocket (12) (13) mounted free on one same sprocket shaft (14), said first sprocket (12) being liable to become separated axially from second sprocket (13), a first pinion (19) being mounted on the end of said sprocket shaft (14) and which engages a third sprocket (20), rotating free on a second shaft (32), said third sprocket (20) being integral with a first eccentric wheel (21) which acts on a first lever (22) to transmit movement to the first arm (5) of the doll, said first arm (5) being provided with a swinging motion which makes a rattler (7) adhered to the hand of said first arm 5 to sound, and to transmit movement to the mouth (4) and causing the opening/closing of said mouth (4) in a simulation act of sucking on said pacifier (2); wherein at a maximum axial separation of said first and second sprockets (12) (13), said, movement of said first arm (5) and mouth stop and rotation starts on said second shaft (32) which carries on an end thereof a second pinion (40) engaging a fourth sprocket (41) and a second eccentric wheel (39) acting on a second lever (43) which cause said second arm (6) to raise to mouth level; said fourth sprocket (41) being integral to a fourth eccentric wheel (5) which causes said second arm (6) to bend and close the hand (57) approaching the mouth, pulling out said pacifier and releasing it abruptly as said second arm (6) moves outward towards into the initial position.

2. A sound-emitting doll according to claim 1, wherein said first sprocket (12) has two opposite sides and said second sprocket (13) rotates free over an internally grooved housing (15) in which a third pinion (16) located on the inner side of said first sprocket (12) engages for a certain period of time while said first sprocket (12) and said second sprocket (13) are in the axially closest position; wherein when said first sprocket and said second sprocket separate as a consequence of said first and second sprockets being fitted with a different number of teeth in order to cause a difference in the angular position thereby causing the first sprocket (12) to be offset axially in regard to the second sprocket (13) through ramps (18) provided on the sides facing each other, causing the disengagement of said third pinion (16) and said internally grooved housing (15), said sprocket shaft (14) integral to said internally grooved housing (15) stops, thereby stopping movement of said first arm (5) and initiating movement of the second arm (6) as this offsetting of said first sprocket (12) causes an opposing portion (16') of said third pinion (16) to mesh with fifth sprocket (38) integral to said second shaft (32).

3. A sound-emitting doll according to claim 1, wherein said first lever (22) is fitted with an opening provided with a concave depression (37) wherein a pivot is located in association with said first arm (5), causing a sudden jump in the swinging motion of said first arm (5) when the appendix (34) of a third eccentric wheel (35) integral to said sprocket shaft (14) impact suddenly on said first lever (22) resulting in sound being emitted from the rattler held in the hand of said first arm (5).

4. Amended) A sound-emitting doll, according to claim 1, wherein said first lever (22) is provided with a crosswise rod (24) emerging laterally and associated with a groove or elongated hole (25) in a head lever (26) having two branches, a first branch (28) which acts through a support (29) when said support (29) retreats, and a second branch being associated with a chin lever (31) attached to the inner area of the chin under the doll's mouth (4) to cause the opening/closing of said mouth.

5. A sound-emitting doll according to claim 1, wherein said second lever (43) is provided with an opening (45) for pivoting a pivot (46) provided in an assembly part of the second arm (6), while said second eccentric wheel (39) is provided with a flat area (42) based on which the hand of said second arm (6) remains fixed for a short period of time at the point it reaches the pacifier (2) for subsequent pulling on said pacifier.

6. A sound-emitting doll according to claim 1, wherein a first cam (47) is provided in an assembly part of said second arm (6) to connect a circuit causing said second arm (6) and hand movement to continue, after said pacifier (2) has been removed, said first cam (47) disconnecting said circuit when said second arm (6) reaches the end of its movement as a result of said first sprocket (12) and said second sprocket (13) closing up, and said second shaft (32) stopping; a second cam (48) also being provided related to said sprocket shaft (14) which will be moving at this moment causing second cam (48) to disconnect the circuit this disconnection of the circuit taking place each time a cycle ends, which corresponds to movements of said first and second arms, other movements of remaining components depending on said first and second arms.

7. A sound-emitting doll according to claim 1, wherein said second shaft (32) incorporates on an opposite end thereof a third cam (33) by means of which a more marked swinging motion relative to that produced by the said first eccentric wheel (21) is provided to said first lever (22), causing a maximum opening of said mouth (4) and thus allowing said second arm (6) to remove said pacifier (2).

* * * * *